US007530360B2

(12) United States Patent
Guzmann et al.

(10) Patent No.: US 7,530,360 B2
(45) Date of Patent: May 12, 2009

(54) USE OF COPOLYMERS, CONTAINING ALKYLENE OXIDE UNITS, AS DEPOSIT INHIBITOR ADDITIVES IN THE RINSING PROCESS OF A DISHWATER

(75) Inventors: Marcus Guzmann, Muehlhausen (DE); Heike Becker, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 275 days.

(21) Appl. No.: 10/577,261

(22) PCT Filed: Oct. 23, 2004

(86) PCT No.: PCT/EP2004/011994

§ 371 (c)(1),
(2), (4) Date: Apr. 26, 2006

(87) PCT Pub. No.: WO2005/042684

PCT Pub. Date: May 12, 2005

(65) Prior Publication Data

US 2007/0082831 A1 Apr. 12, 2007

(30) Foreign Application Priority Data

Oct. 28, 2003 (DE) ..... 103 50 420

(51) Int. Cl.
*B08B 3/04* (2006.01)
*C11D 3/37* (2006.01)

(52) U.S. Cl. ..... 134/25.2; 134/25.3; 134/39; 134/42; 510/223; 510/229; 510/230; 510/434; 510/475; 510/476; 510/477; 526/317.1

(58) Field of Classification Search ..... 510/223, 510/229, 230, 434, 475, 476, 477; 526/317.1; 134/25.2, 39, 25.3, 42
See application file for complete search history.

(56) References Cited

U.S. PATENT DOCUMENTS

2003/0158361 A1* 8/2003 Yoneda et al. ..... 526/317.1

FOREIGN PATENT DOCUMENTS

| | | | |
|---|---|---|---|
| DE | 43 21 430 | | 1/1995 |
| DE | 100 32 612 | | 2/2002 |
| EP | 1 300 426 | | 4/2003 |
| JP | 03185184 | * | 8/1991 |
| JP | 2000024691 | * | 1/2000 |
| WO | 03 104373 | | 12/2003 |

* cited by examiner

*Primary Examiner*—Brian P Mruk
(74) *Attorney, Agent, or Firm*—Oblon, Spivak, McClelland, Maier & Neustadt, P.C.

(57) ABSTRACT

Use of copolymers comprising alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

I

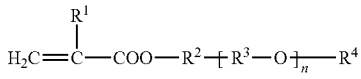

in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, as deposit-inhibiting additives in the rinsing cycle of a dishwasher.

18 Claims, No Drawings

USE OF COPOLYMERS, CONTAINING ALKYLENE OXIDE UNITS, AS DEPOSIT INHIBITOR ADDITIVES IN THE RINSING PROCESS OF A DISHWATER

The present invention relates to the use of copolymers comprising alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

I

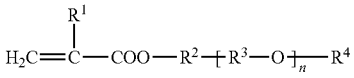

in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, as deposit-inhibiting additives in the rinsing cycle of a dishwasher.

In addition, the invention relates to rinse aids for dishwashers which comprise these copolymers as deposit-inhibiting additive, and also to detergent tablets for dishwashers which comprise the copolymers formulated into the rinse aid core as deposit-inhibiting additive.

In the case of machine dishwashing, the ware should be obtained in a residue-free cleaned state with a flawlessly shiny surface. The ware should not only be completely cleaned of food residues, but should also have no whitish marks which arise due to the presence of limescale or other inorganic and organic salts as water drops dry up.

For this reason, rinse aids have been used for a relatively long time. Here, the rinse aid is automatically released from a dosing chamber in the inside of the dishwasher in the rinsing cycle following completion of the wash program, which usually consists of a prewash cycle and a main wash cycle interrupted by interim rinse cycles, and ensures that the water during the rinsing cycle and drying cycle runs off from the ware in a manner which is flat and as complete as possible, and the surfaces of the ware are residue-free and flawlessly shiny at the end of the wash program.

In the case of the so-called "2in1" detergents on the market, rinsing surfactants have already been integrated into the detergent formulation, meaning that it is possible to dispense with the additional dosing of a rinse aid.

Modern machine "3in1" detergents combine the three functions of cleaning, clear rinsing and water softening in a single detergent formulation, meaning that for the consumer the topping-up of salt for water hardnesses from 1 to 3 becomes superfluous. To bind the hardness-forming calcium and magnesium ions, sodium tripolyphosphate is usually added to these detergents. This, however, again results in calcium phosphate and magnesium phosphate deposits on the ware.

The object of the invention was to provide polymeric additives which are characterized by their deposit-inhibiting effect when used in the rinsing cycle of a dishwasher.

Accordingly, the use of copolymers comprising alkylene oxide units which comprise, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and

I

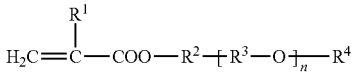

in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, as deposit-inhibiting additives in the rinsing cycle of a dishwasher has been found.

In addition, rinse aids for dishwashers which comprise these copolymers as deposit-inhibiting additive have been found.

In addition, detergent tablets for dishwashers have been found which comprise these copolymers as deposit-inhibiting additive formulated into the rinse aid core.

The copolymers to be used according to the invention are described in DE-A-102 25 594, which was unpublished at the priority date of the invention, as additive for detergents and cleaners.

The copolymers comprising alkylene oxide units to be used according to the invention comprise, as copolymerized components (a) and (b), acrylic acid and methacrylic acid and/or water-soluble salts of these acids, in particular the alkali metal salts, such as potassium salts and especially sodium salts, and ammonium salts.

The amount of acrylic acid (a) in the copolymers to be used according to the invention is 50 to 93 mol %, preferably 65 to 85 mol % and particularly preferably 65 to 75 mol %.

Methacrylic acid (b) is present in the copolymers to be used according to the invention in an amount of from 5 to 30 mol %, preferably in an amount of from 10 to 25 mol % and especially in an amount of from 15 to 25 mol %.

The copolymers comprise, as component (c), nonionic monomers of the formula I

I

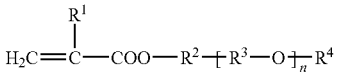

in which the variables have the following meanings:

$R^1$ is hydrogen or preferably methyl;

$R^2$ is unbranched or branched $C_1$-$C_6$-alkylene or preferably a chemical bond;

$R^3$ is identical or different unbranched or branched $C_2$-$C_4$-alkylene radicals, especially $C_2$-$C_3$-alkylene radicals, in particular ethylene;

$R^4$ is unbranched or branched $C_1$-$C_6$-alkyl, preferably $C_1$-$C_2$-alkyl;

n is 3 to 50, preferably 5 to 40, particularly preferably 10 to 30.

Particularly suitable examples of the monomers II which may be mentioned are: methoxypolyethylene glycol(meth) acrylate, methoxypolypropylene glycol(meth)acrylate, methoxypolybutylene glycol(meth)acrylate, methoxypoly (propyleneoxide-coethyleneoxide) (meth)acrylate, ethoxy-polyethylene glycol(meth)acrylate, ethoxypoly-propylene glycol(meth)acrylate, ethoxypolybutylene glycol(meth) acrylate and ethoxy-poly(propylene oxide-co-ethylene oxide) (meth)acrylate, where methoxypolyethylene glycol (meth)acrylate and methoxypolypropylene glycol(meth) acrylate are preferred and methoxypolyethylene glycol methacrylate is particularly preferred.

The polyalkylene glycols here comprise 3 to 50, in particular 5 to 40 and especially 10 to 30 alkylene oxide units.

The amount of nonionic monomers (c) in the copolymers to be used according to the invention is 2 to 20 mol %, preferably 5 to 15 mol % and especially 5 to 10 mol %.

The copolymers to be used according to the invention generally have an average molecular weight $M_w$ of from 3000 to 50 000, preferably from 10 000 to 30 000 and particularly preferably from 15 000 to 25 000.

The K value of the copolymers is usually 15 to 40, in particular 20 to 35, especially 27 to 30 (measured in 1% strength by weight aqueous solution at 25° C., in accordance with H. Fikentscher, Cellulose-Chemie, Vol.13, pp. 58-64 and 71-74 (1932)).

The copolymers to be used according to the invention can be prepared by free-radical polymerization of the monomers. In this connection, all known free-radical polymerization processes can be used. Besides bulk polymerization, the processes of solution polymerization and of emulsion polymerization are to be mentioned in particular, with solution polymerization being preferred.

The polymerization is preferably carried out in water as solvent. It can, however, also be carried out in alcoholic solvents, in particular $C_1$-$C_4$-alcohols, such as methanol, ethanol and isopropanol, or mixtures of these solvents with water.

Suitable polymerization initiators are compounds which either decompose thermally or photochemically (photoinitiators) to form free radicals.

Among the thermally activatable polymerization initiators, preference is given to initiators with a decomposition temperature in the range from 20 to 180° C., in particular from 50 to 90° C. Examples of suitable thermal initiators are inorganic peroxo compounds, such as peroxodisulfates (ammonium and preferably sodium peroxodisulfate), peroxosulfates, percarbonates and hydrogen peroxide; organic peroxo compounds, such as diacetyl peroxide, di-tert-butyl peroxide, diamyl peroxide, dioctanoyl peroxide, didecanoyl peroxide, dilauroyl peroxide, dibenzoyl peroxide, bis(o-tolyl)peroxide, succinyl peroxide, tert-butyl peracetate, tert-butyl permaleate, tert-butyl perisobutyrate, tert-butyl perpivalate, tert-butyl peroctoate, tert-butyl perneodecanoate, tert-butyl perbenzoate, tert-butyl peroxide, tert-butyl hydroperoxide, cumene hydroperoxide, tert-butyl peroxy-2-ethylhexanoate and diisopropyl peroxydicarbamate; azo compounds, such as 2,2'-azobisisobutyronitrile, 2,2'-azobis(2-methylbutyronitril) and azobis(2-amido-propane)dihydrochloride.

These initiators can be used in combination with reducing compounds as starter/regulator systems. Examples of such reducing compounds which may be mentioned are phosphorus-containing compounds, such as phosphorus acid, hypophosphites and phosphinates, sulfur-containing compounds, such as sodium hydrogen sulfite, sodium sulfite and sodium formaldehyde sulfoxilate, and hydrazine.

Examples of suitable photoinitiators are benzophenone, acetophenone, benzoin ether, benzyl dialkyl ketones and derivatives thereof.

Preferably, thermal initiators are used, preference being given to inorganic peroxo compounds, in particular sodium peroxodisulfate (sodium persulfate). The peroxo compounds are advantageously used in combination with sulfur-containing reducing agents, in particular sodium hydrogensulfite, as redox initiator system. The use of this starter/regulator system produces copolymers which comprise $—SO_3^-Na^+$ and/or $—SO_4^-Na^+$ as end groups and are characterized by particular deposit-inhibiting effect.

Alternatively, it is also possible to use phosphorus-containing starter/regulator systems, e.g. hypophosphites/phosphinates.

The amounts of photoinitiator and/or starter/regulator system should be matched to the substances used in each case. If, for example, the preferred system of peroxodisulfate/hydrogensulfite is used, then usually 2 to 6% by weight, preferably 3 to 5% by weight of peroxodisulfate and usually 5 to 30% by weight, preferably 5 to 10% by weight, of hydrogensulfite, in each case based on the monomers (a), (b) and (c), are used.

If desired, it is also possible to use polymerization regulators. Suitable compounds are those known to the person skilled in the art, e.g. sulfur compounds, such as mercaptoethanol, 2-ethylhexyl thioglycolate, thioglycolic acid and dodecyl mercaptan. If polymerization regulators are used, their use amount is usually 0.1 to 15% by weight, preferably 0.1 to 5% by weight and particularly preferably 0.1 to 2.5% by weight, based on the monomers (a), (b) and (c).

The polymerization temperature is usually 30 to 200° C., preferably 50 to 150° C. and particularly preferably 80 to 120° C.

The polymerization can be carried out under atmospheric pressure, although it is preferably carried out in a closed system under the autogenous pressure which develops.

In the preparation of the copolymers to be used according to the invention, the monomers (a), (b) and (c) can be used as they are, although it is also possible to use reaction mixtures which are produced in the preparation of the monomers (c). Thus, for example, instead of methoxypolyethylene glycol methacrylate, it is possible to use the monomer mixture produced during the esterification of polyethylene glycol monomethyl ether with an excess of methacrylic acid. Advantageously, the esterification can also be carried out in situ in the polymerization mixture by mixing together in parallel (1) acrylic acid, (2) a mixture of methacrylic acid and polyethylene glycol monomethyl ether and (3) free-radical initiator. If appropriate, a catalyst necessary for the esterification, such as methanesulfonic acid or p-toluenesulfonic acid, can be additionally used.

The copolymers to be used according to the invention can also be prepared by a polymer-analogous reaction, e.g. by reacting an acrylic acid/methacrylic acid copolymer with polyalkylene glycol monoalkyl ether. However, preference is given to the free-radical copolymerization of the monomers.

If desired for the application, the aqueous solutions produced during the preparation of the copolymers containing carboxylic acid groups to be used according to the invention can be neutralized or partially neutralized, i.e. to a pH in the range 4-8, preferably 4.5-7.5, by adding base, in particular sodium hydroxide solution.

The copolymers used according to the invention are characterized by their excellent deposit-inhibiting effect when used in the rinsing cycle of a dishwasher.

In this connection, they have an inhibiting effect both for inorganic and organic deposits. In particular, mention may be made of deposits which are caused by the constituents of the detergent formulation entrained into the rinsing cycle by the "carry-over effect", such as deposits of calcium phosphate and magnesium phosphate, calcium silicate and magnesium silicate and calcium phosphonate and magnesium phosphonate, and deposits which originate from the soiling constituents of the wash liquor, such as grease, protein and starch deposits. The copolymers to be used according to the invention improve the cleaning result with lasting effect as a result of their deposit-inhibiting effect. In addition, even at low concentrations, they favor the run-off of water from the ware, meaning that the amount of rinsing surfactants in the dishwashing detergents can be reduced. Accordingly, particularly clear glassware and very shiny metal cutlery items are obtained, particularly also when the dishwasher is operated without regenerating salt to soften the water.

The copolymers used according to the invention can be used directly in the form of the aqueous solutions produced during the preparation, or else in dried form obtained, for example, by spray drying, fluidized spray drying, drum drying or freeze-drying.

The copolymers according to the invention can advantageously be used in particular as follows:

- dissolved in a rinse aid formulation which is automatically metered in the dishwasher at the start of the rinsing cycle.
- formulated into the rinsing core of a dishwasher tablet from which they are released in a targeted manner in the rinsing cycle.
- in the form of a solid obtained by one of the methods described above, which is additionally provided with a coating which is soluble under the rinsing conditions (temperature, pH, residual concentration of detergent components in the rinsing cycle), or is incorporated into a matrix which is soluble under these conditions, and is introduced into the machine together with the detergent, but is only released in the rinsing cycle.
  - A suitable coating material for this purpose is, for example, polyvinyl alcohol prepared by incomplete hydrolysis of polyvinyl acetate (degree of hydrolysis of usually 88 to 98%, preferably 89 to 95%, particularly preferably 91 to 92%).
  - Suitable matrix materials are, for example, gelatin, polyvinyl alcohol, polyvinylpyrrolidone, polyethylene oxide, cellulose and derivatives thereof, starch and derivatives thereof and mixtures of these materials.

EXAMPLES

A) Preparation

Example 1

In a reactor with nitrogen inlet, reflux condenser and metering device, a mixture of 619 g of distilled water and 2.2 g of phosphorous acid was heated to an internal temperature of 100° C. while introducing nitrogen and with stirring. Then, in parallel, (1) a mixture of 123.3 g of acrylic acid and 368.5 g of distilled water, (2) a mixture of 18.4 g of sodium peroxodisulfate and 164.6 g of distilled water, (3) a mixture of 72.0 g of water, 49.1 g of methacrylic acid and 166.9 g of methoxypolyethylene glycol methacrylate ($M_w$=1100) and (4) 46 g of a 40% strength by weight aqueous sodium hydrogensulfite solution were continuously added over 5 h. After after-stirring for two hours at 100° C., the reaction mixture was cooled to room temperature and adjusted to a pH of 7.2 by adding 190 g of 50% strength by weight of sodium hydroxide solution.

A slightly yellowish, clear solution of a copolymer with a solids content of 25.7% by weight and a K value of 27.2 (1% strength by weight aqueous solution, 25° C.) was obtained.

B) Use in machine dishwashing

B1) Simulation of a 3in1 dishwasher formulation with additional copolymer release in the rinsing cycle To test its rinsing effect, the copolymer according to the invention was used together with a standard commercial 3in1 dishwasher formulation in tablet form (Somat), the copolymer only being added in the rinsing cycle in order to simulate a delayed release of further copolymer.

The test was carried out under the following washing conditions with the addition of IKW ballast soiling (SÖFW Journal, volume 124, 14/98, p. 1029) in the main wash cycle and additionally to the copolymer in the rinsing cycle. In addition, neither regenerating salt nor rinsing aid formulation were used.

Washing conditions:

| | |
|---|---|
| Dishwasher: | Miele G 686 SC |
| Wash cycles: | 1 wash cycle 55° C. normal (without prewash) |
| Ware: | Knives (WMF Tafelmesser Berlin, monoblock); glasses (lager glasses, 0.3 l); black KS plates, black dessert plates; EMSA Superline - box (lid PE blue, PP box transparent) |
| Detergent: | Somat 3 in 1 |
| Ballast soiling: | 50 g in the main wash cycle; 2 g in the rinsing cycle |
| Copolymer: | 210 mg in the rinsing cycle |
| Rinsing temperature: | 65° C. |
| Water hardness: | 21° German hardness |

At the end of the wash cycle, the door was opened and the dishes were left to dry for 60 min with the machine door open. The ware was then evaluated by visual assessment in a black-painted light box with halogen spot light and aperture plate using a grading scale from 0 (very poor, very considerable formation of dried drops (spotting), i.e. more than 50% of the surface covered with spots, very considerable formation of flat deposits (filming)) to 4 (very good, no spots, no filming).

The test results obtained are listed in Table 1, the results without the addition of copolymer being listed for comparison.

TABLE 1

| | Evaluation (grade) | | |
|---|---|---|---|
| | Knives, glasses, ceramic plates | | Plastic items |
| Copolymer from Ex. | Spotting | Filming | Spotting |
| 1 | 2.2 | 2.6 | 1.2 |
| — | 1.8 | 2.0 | 0.8 |

B2) Use in a rinsing aid formulation

To test the rinsing effect in the rinse aid, the copolymer was added directly to the rinse aid formulation. The test was carried out under the conditions given below with the addition of IKW ballast soiling in the main wash and rinsing cycle.

The detergent used was with the following formulation:

| | |
|---|---|
| 50% by weight | Sodium tripolyphosphate ($Na_3P_3O_{10}$•$6H_2O$) |
| 27% by weight | Sodium carbonate |

-continued

| | |
|---|---|
| 3% by weight | Sodium disilicate ($xNa_2O \bullet ySiO_2$; x/y = 2.65; 80% strength by weight) |
| 6% by weight | Sodium percarbonate ($Na_2CO_3 \bullet 1.5H_2O$) |
| 2% by weight | Tetraacetylethylenediamine (TAED) |
| 2% by weight | Low-foam nonionic surfactant based on fatty alcohol alkoxylates |
| 3% by weight | Sodium chloride |
| 5% by weight | Sodium sulfate |
| 2% by weight | Polyacrylic acid sodium salt ($M_w$ 8000) |

The copolymer was used in the following rinse aid formulation:

| | |
|---|---|
| 20% by weight | Low-foam nonionic surfactant based on fatty alcohol alkoxylates |
| 10% by weight | Sodium cumenesulfonate (40% strength by weight) |
| 5% by weight | Isopropanol |
| 4% by weight | Copolymer (active substance) |
| 61% by weight | Water |

The following washing conditions were used:

| | |
|---|---|
| Dishwasher: | Miele G 686 SC |
| Wash cycles: | 1 wash cycle 55° C. normal (without prewash) |
| Ware: | Knives (WMF Tafelmesser Berlin, monoblock); glasses (lager glasses, 0.3 l); black KS plates, black dessert plates; EMSA Superline - box (lid PE blue, PP box transparent) |
| Detergent: | 21 g |
| Ballast soiling: | 50 g in the main wash cycle; 2 g in the rinsing cycle |
| Rinsing temperature: | 65° C. |
| Rinse aid dose: | 1 g |
| Water hardness: | 3° German hardness |

At the end of the wash cycle, the door was opened and the dishes were left to dry for 60 min with the machine door open. The ware was then evaluated by visual assessment in a black-painted light box with halogen spotlight and aperture plate using the grading scale from 0 to 4 described above.

The test results obtained are listed in Table 2, the results without the addition of copolymer being listed for comparison.

TABLE 2

| | Evaluation (grade) | |
|---|---|---|
| Copolymer from Ex. | Knives, glasses, ceramic plates Spotting | Plastic items Spotting |
| 1 | 2.2 | 1.7 |
| — | 2.0 | 1.4 |

The invention claimed is:

1. A method comprising operating a machine dishwasher with a rinse aid contained therein which comprises, as a depositing-inhibiting additive, a copolymer comprising alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

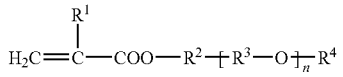

I in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, wherein the copolymer has a weight average molecular weight of from 3,000 to 30,000.

2. The method according to claim 1, wherein the copolymers comprise 65 to 85 mol % of component (a), 10 to 25 mol % of component (b) and 5 to 15 mol % of component (c) in copolymerized form.

3. The method according to claim 1, wherein the copolymer comprises 65 to 75 mol % of component (a), 15 to 25 mol % of component (b) and 5 to 10 mol % of component (c) in copolymerized form.

4. The method according to claim 1, wherein the copolymer comprises, as component (c), a nonionic monomer of the formula I, in which $R^1$ is methyl, $R^2$ is a chemical bond, $R^3$ is $C_2$-$C_3$-alkylene, $R^4$ is $C_1$-$C_2$-alkyl and n is 5 to 40, in copolymerized form.

5. The method according to claims 1, wherein the copolymer comprises, as component (c), a nonionic monomer of the formula I, in which $R^1$ is methyl, $R^2$ is a chemical bond, $R^3$ is ethylene, $R^4$ is methyl and n is 10 to 30, in copolymerized form.

6. The method according to claims 1, wherein the copolymers comprise $—SO_3^{-Na+}$ and/or $—SO_4^-Na^+$ as end groups.

7. The method according to claim 1, wherein the copolymer has a weight average molecular weight of from 10,000 to 30,000.

8. The method according to claim 1, wherein the copolymer has a weight average molecular weight of from 15,000 to 25,000.

9. The method according to claim 1, wherein the copolymer has a K value of from 15 to 40.

10. The method according to claim 1, wherein the copolymer has a K value of from 20 to 35.

11. The method according to claim 1, wherein the copolymer has a K value of from 27 to 30.

12. The method according to claim 1, wherein deposits originating from soiling constituents of a wash liquor are inhibited.

13. A method comprising operating a machine dishwasher with a rinse aid contained therein which comprises, as a depositing-inhibiting additive, a copolymer comprising alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

I

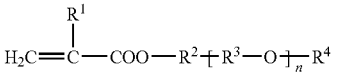

in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, wherein the copolymer is in solid form and provided with a coating therein which is soluble under rinsing conditions of the dishwasher.

14. The method according to claim 13, wherein the coating comprises polyvinyl alcohol.

15. A method comprising operating a machine dishwasher with a rinse aid contained therein which comprises, as a depositing-inhibiting additive, a copolymer comprising alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

I

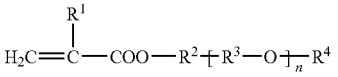

in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, wherein the copolymer is incorporated into a matrix which is soluble under rinsing conditions, and is introduced into the dishwasher together with a detergent, but is released only in a rinsing cycle of the dishwasher.

16. The method according to claim 15, wherein the matrix material is selected from the group consisting of gelatin, polyvinyl alcohol, polyvinylpyrrolidone, polyethylene oxide, cellulose and derivatives thereof, starch and derivatives thereof, and mixtures thereof.

17. A solid composition comprising a coated tablet comprising a copolymer, which copolymer comprises alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

I

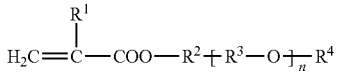

in which the variables have the following meanings:

$R^1$ is hydrogen or methyl; 2

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, and wherein the coating is soluble under rinsing conditions of a machine dishwasher.

18. A solid composition comprising a copolymer incorporated into a matrix, which copolymer comprises alkylene oxide units and comprising, in randomly or blockwise copolymerized form, (a) 50 to 93 mol % of acrylic acid and/or a water-soluble salt of acrylic acid, (b) 5 to 30 mol % of methacrylic acid and/or a water-soluble salt of methacrylic acid and (c) 2 to 20 mol % of at least one nonionic monomer of the formula I

I

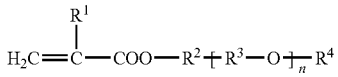

in which the variables have the following meanings:

$R^1$ is hydrogen or methyl;

$R^2$ is a chemical bond or unbranched or branched $C_1$-$C_6$-alkylene;

$R^3$ is identical or different unbranched or branched $C_2$-$C_4$-alkylene radicals;

$R^4$ is unbranched or branched $C_1$-$C_6$-alkyl;

n is 3 to 50, and wherein the composition is releasable only in a rinsing cycle of a machine dishwasher.

* * * * *

UNITED STATES PATENT AND TRADEMARK OFFICE

CERTIFICATE OF CORRECTION

PATENT NO. : 7,530,360 B2
APPLICATION NO. : 10/577261
DATED : May 12, 2009
INVENTOR(S) : Guzmann et al.

It is certified that error appears in the above-identified patent and that said Letters Patent is hereby corrected as shown below:

On the title page, Item (54), and Column 1, the title information is incorrect. Item (54) and Column 1 should read:

-- (54) USE OF COPOLYMERS, CONTAINING ALKYLENE OXIDE UNITS, AS DEPOSIT INHIBITOR ADDITIVES IN THE RINSING PROCESS OF A DISHWASHER --

Signed and Sealed this

Thirtieth Day of June, 2009

JOHN DOLL
*Acting Director of the United States Patent and Trademark Office*